United States Patent [19]

Hartinger Machalek

[11] 4,273,245

[45] Jun. 16, 1981

[54] INSULATED GLASS VESSEL

[76] Inventor: Pio Hartinger Machalek, Pershing 287, Lima, Peru

[21] Appl. No.: 745,246

[22] Filed: Nov. 26, 1976

[51] Int. Cl.[3] ..... B65D 6/10

[52] U.S. Cl. ..... 215/13 R; 220/444

[58] Field of Search ..... 215/13 R; 220/444, 453, 220/468

[56] References Cited

U.S. PATENT DOCUMENTS

| | | | |
|---|---|---|---|
| Re. 23,106 | 5/1949 | Gulick | 215/13 R |
| 1,968,263 | 7/1934 | Reuther | 215/13 R |
| 1,997,055 | 4/1935 | Graefe | 215/13 R |
| 2,051,446 | 8/1936 | Ice | 215/13 R |
| 2,169,426 | 8/1939 | Morton | 215/13 R |
| 2,368,273 | 1/1945 | Tibbetts | 215/13 R |
| 2,715,326 | 8/1955 | Gits | 215/13 R |
| 3,120,570 | 2/1964 | Kennedy | 215/13 R |
| 3,285,456 | 11/1966 | Pewitt | 215/13 R |
| 3,355,045 | 11/1967 | Douglas | 215/13 R |
| 3,827,925 | 8/1974 | Douglas | 215/13 R |

FOREIGN PATENT DOCUMENTS

| | | | |
|---|---|---|---|
| 651776 | 1/1963 | Italy | 150/0.5 |

*Primary Examiner*—Donald F. Norton

*Attorney, Agent, or Firm*—Wenderoth, Lind & Ponack

[57] ABSTRACT

A vessel includes a glass or crystal body, an upper part of which has a widened diameter, and a lower part of which has a smaller diameter. The lower part is covered by a rigid shell which is made of plastics material and which is firmly bonded to the glass body in a permanent and solid manner. The shell and the upper part form a continuous and symmetrical outer surface.

5 Claims, 3 Drawing Figures

INSULATED GLASS VESSEL

BACKGROUND OF THE INVENTION

This invention relates to the manufacture of heat insulated glass or crystal articles, and more particularly to the manufacture of drinking glasses, decanters, vessels, etc., provided with a lining made of a heat insulating material, which lining is permanently fastened to the bottom and side walls of the glass article for the purpose of conserving the temperature of its contents for a relatively long period of time.

As is known, a liquid contained in a drinking glass at a temperature different from atmospheric temperature undergoes a rapid temperature change due to thermal conductivity through the walls of the glass. This temperature change takes place at a slow and decreasing rate until equilibrium between the liquid temperature and the surrounding medium temperature is reached. This thermal conductivity of glass or crystal is inconvenient when it is desired to conserve the liquid at a temperature substantially different from ambient temperature. Also, the heat developed by the hand of the user while holding the drinking glass or vessel is transmitted through the wall of the vessel, thus increasing the temperature of the contents to a level higher than ambient temperature. Moreover, when the contents of the drinking glass or vessel is at a very low temperature with regard to the temperature of the user's hand, the glass rapidly takes such inner lower temperature, thus causing an unpleasant sensation to the user holding the glass during a long period of time, while the heat exchange is taking place.

Further, when a glass is used to contain cold drinks of any type, the external wall of the glass cools down rapidly, thus causing condensation of atmospheric water vapor, and water droplets deposit on such external surface. The water droplets progressively increase in size, join together and slide down the walls to the base of the glass, and then deposit on the surface of the piece of furniture that supports the glass, thus leaving portions of water on the piece of furniture. This of course damages the furniture when it is made of a material sensitive to water. This condensation of moisture on the external wall of the glass is also an inconvenience to the user, since his hands become wet when holding the glass to drink its contents.

With the purpose of avoiding these inconveniences, and particularly when the glass is used for cold liquids, or when it contains pieces of ice, it is customary to use glasses with thick bottoms and walls, such as those used for whiskey, with the purpose of offering resistance to the flow of heat. However, heat transfer is not prevented, but merely takes place at a slower rate, and after a time the same unpleasant effects takes place. Sometimes, to avoid the formation of water on furniture, it is customary to put the glass on special seats, or to insert the glass into hollow cylindrical bases which are made of different types of materials and which receive the water condensed on the outside of the glass, thus preventing the water from spreading onto the piece of furniture.

SUMMARY OF THE INVENTION

As a solution to the above mentioned problems, the present invention provides a useful and simple system for keeping the liquid or solid contents of a vessel or drinking glass at a substantially stable temperature during a long period of time, whether the contents are cold or hot, without causing inconvenience to the user or damage to furniture.

The present invention includes a glass or crystal vessel having an upper part of a widened diameter, and a lower part with a smaller diameter, a step being formed between these two parts. The lower part is permanently covered with a capsule or shell of plastics material having a low thermal conductivity. The capsule has an interior diameter greater than the outer diameter of the lower part of the vessel or drinking glass, and an outer diameter symmetrically equivalent to the outer diameter of the upper part of the vessel or drinking glass.

According to the invention, between the wall of the capsule and the wall of the lower part of the vessel, there is formed a peripheral space which is filled with a synthetic solidifying resin which is firmly adhered to both walls, thus forming a solid and permanent attachment and contributing to the heat insulating properties provided by the capsule.

The capsule is provided on the walls and bottom thereof with regularly spaced interior ribs which center and guide the lower part of the vessel within the capsule.

The vessel may be hand blown, machine blown or pressed, and the capsule may be formed or extruded by machines which are conventional for such purposes.

The invention is mainly directed to drinking glasses for containing cold drinks. However, the invention is also applicable to containers for ice cubes and ice cream, and to other utensils such as cocktail containers, cups, jars, decanters, and generally any article for home use or any application, made of glass or crystal, wherein there is the need for maintaining the contents at a steady temperature during some period of time.

Therefore, one of the objects of the present invention is to provide a vessel which is made of glass or crystal and which is provided at a lower portion thereof with a permanent heat insulation, for the purpose of maintaining the contents of the vessel at a temperature different from that of the surrounding medium.

Another object of the present invention is to provide a glass or crystal article fitted with a permanent heat insulating attachment which also serves as an ornament.

Another object of the present invention is to provide a glass or crystal article for containing cold or hot substances without producing inconvenience to the user during handling.

These and other objects and advantages of the invention will be more easily understood from the following description and from the figures, showing a preferred embodiment of the present invention, which is disclosed for the sole purpose of illustration, and which is not intended to be limiting, since it is apparent that many modifications or variations may be made, without departing from the scope of the invention.

BRIEF DESCRIPTION OF THE DRAWINGS

An application of the invention to a drinking glass will now be described with reference to the attached figures, but it is obvious that this invention is applicable, in the same way, to any of the above mentioned articles, which are not illustrated so as to not unnecessarily extend the description.

DETAILED DESCRIPTION OF THE INVENTION

Figure 1:
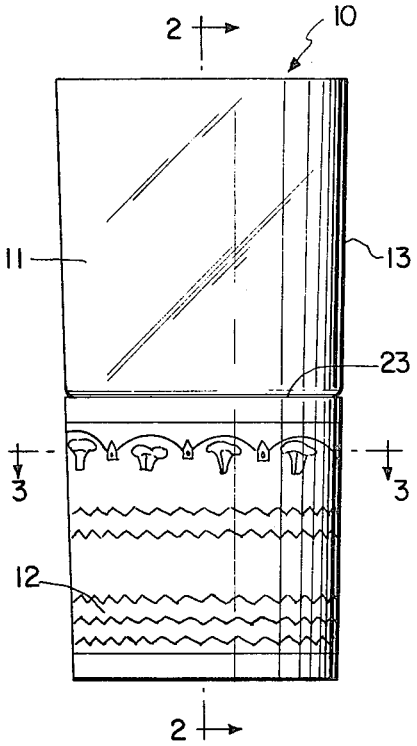
FIG. 1 is a front view of a drinking glass manufactured according to the invention and including a shell of plastics material permanently bonded to the lower part of the body of the drinking glass.
Figure 2:
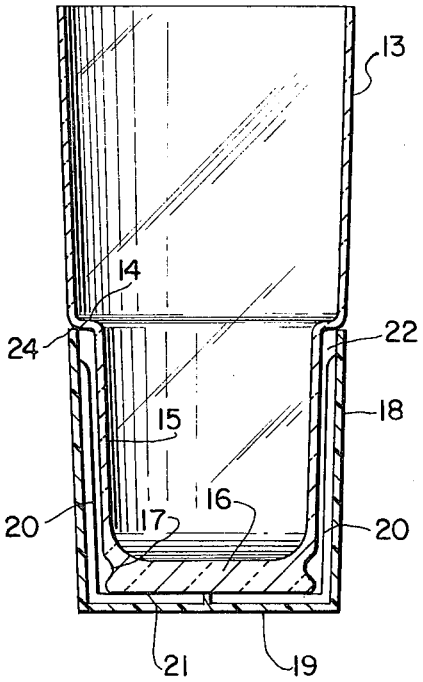
FIG. 2 is a cross-section taken along line 2—2 of FIG. 1, showing the special shape of the glass or crystal article, and the corresponding shell, as well as the intermediate space filled with bonding material.
Figure 3:
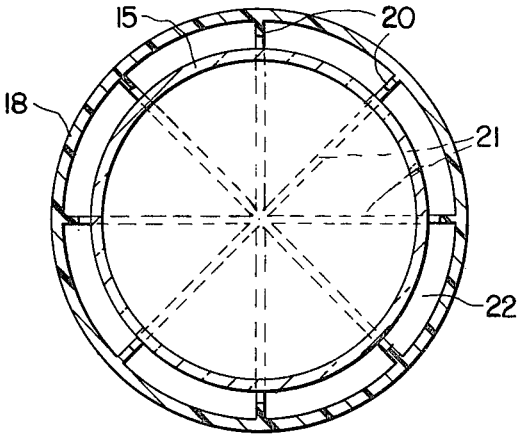
FIG. 3 is a cross-section taken along line 3—3 of FIG. 1, showing the arrangement of the interior ribs of the shell, which ribs guide and center the glass, and serve as spacers between the interior surface of the shell and the outer surface of the glass.

With reference to the drawings, in which like numbers represent similar parts or elements, a drinking glass assembly 10 includes a glass or crystal article 11 covered at the lower part thereof by a shell 12 formed of plastics material which is heat insulating. The assembly 10 formed with the glass 11 and the shell 12 is firmly and permanently bonded together with the purpose of constituting an indivisible assembly. The drinking glass 11 made of glass or crystal includes an upper part 13 which is externally uncovered, with walls which are straight or inclined. The diameter of glass 11 is suddenly reduced to form a step 14, from which the walls of the lower part 15 of the glass extend downwardly at the same degree of inclination as the walls of upper part 13. The walls of upper and lower parts 13 and 15 have the same thickness. Lower part 15 terminates in a reinforced bottom 16 which forms a flat and horizontal base. This thick and reinforced bottom 16 has therein an outer annular groove 17, for purposes that will be described below.

The glass 11 of this special shape is manufactured by any of the conventional methods used in the art, and has the specific features that the walls of parts 13 and 15 are of a uniform thickness, and that the intermediate step 14 has a rounded outer edge and forms an interior angle which is a right angle.

The shell 12 is manufactured of plastics material, preferably of polystyrene, according to known forming procedures, and includes a tubular member 18 having walls which extend at the same inclination as walls of parts 13 and 15 of the glass 11. The interior diameter of tube 18 is greater than the outer diameter of the lower part 15, and the outer diameter of tube 18 is coincident with the surface of revolution of the upper part 13. Thus, the outer surface of the entire assembly is continuous and symmetrical, ending in a flat base 19 which closes the bottom of tube 18. The shell 12 is provided internally thereof with the vertical ribs 20 which are regularly circumferentially spaced, and with horizontally extending ribs 21 on the upper surface of the base 19.

Ribs 20 allow the coaxial alignment of the lower part 15 of the glass within the shell 12, thereby forming an intermediate space 22, which is filled with a suitable setting synthetic resin, such as an epoxy resin, firmly adhering both to the bottom part 15 of the glass and to the interior wall of shell 12, thus forming a solid and unbreakable bond between the two elements.

For the purpose of making the joint 23 between the two elements as invisible as possible, the upper edge 24 of the shell 12 is beveled, thereby forming an inclined surface to serve as a contact support for the rounded edge of the step 14, and to also serve to coaxially center the glass and shell, thereby preventing the formation of a large groove in joint 23.

All the space 22 between the glass 11 and shell 12 is filled with resin, and such resin also penetrates into the annular groove 17, thereby setting into groove 17 and forming a rigid bead that secures the attachment of the glass inside the shell.

Since the shell 12 is formed of plastic material, it can be manufactured in any attractive and striking color, with the outer surface thereof engraved with drawings, pictures, emblems or coats of arms, in high relief or bas relief, thereby giving a high decorative effect to the assembly.

The manufacturing procedure is extremely simple, and only consists of independently preforming the desired drinking glass 11, or glass article, and the shell 12 made of plastics material, and then inserting the glass into the shell, a predetermined amount of foamed resin having been added into the shell for the purpose of filling the intermediate or annular space. The forming reaction takes place in a short time, thereby forming a solid and permanent attachment.

It will be apparent that various modifications may be made to the above specifically described arrangements without departing from the scope of the invention.

I claim:

1. A vessel assembly comprising:

a glass vessel formed of glass or crystal and having an upper portion and a lower portion, said upper portion having a diameter greater than the diameter of said lower portion, said upper and lower portions being integrally formed and being joined by a step;

a substantially tubular shell formed of a plastic material having a low thermal conductivity;

said glass vessel being positioned within said shell such that said shell surrounds said lower portion of said glass vessel;

said shell having an inner diameter greater than the outer diameter of said lower portion of said glass vessel, thereby forming an annular space therebetween;

said annular space being completely filled with a synthetic resin material having a low thermal conductivity, said resin material being firmly bonded to the interior of said shell and the exterior of said lower portion of said glass vessel, thereby forming a permanently joined and solid assembly; and said shell having an outer surface which is symmetrical with and a continuation of the outer surface of said upper portion of said glass vessel, such that the outer surface of said assembly is continuous and unbroken.

2. An assembly as claimed in claim 1, wherein said lower portion of said glass vessel is closed by a thickened base having therein an outer annular groove, said resin material extending into said groove.

3. An assembly as claimed in claim 1, wherein the outer surface of said glass vessel, at the juncture of said step and said upper portion of said glass vessel, is rounded to form an annular rounded surface, and the upper edge of said shell is beveled, said rounded surface resting on said beveled surface.

4. An assembly as claimed in claim 1, wherein said shell has on the inner surface thereof vertically extending ribs, said ribs being equally circumferentially spaced.

5. An assembly as claimed in claim 4, wherein said shell is closed at the bottom thereof by a base, said base having on the upper surface thereof radially extending ribs.

* * * * *